US007093301B1

(12) United States Patent
Moore, Jr.

(10) Patent No.: US 7,093,301 B1
(45) Date of Patent: Aug. 22, 2006

(54) EQUESTRIAN VEST

(75) Inventor: James B. Moore, Jr., Cincinnati, OH (US)

(73) Assignee: Casco Manufacturing Solutions, Inc., Cincinnati, OH (US)

( * ) Notice: Subject to any disclaimer, the term of this patent is extended or adjusted under 35 U.S.C. 154(b) by 23 days.

(21) Appl. No.: 10/983,777

(22) Filed: Nov. 8, 2004

(51) Int. Cl.
*A41D 13/00* (2006.01)

(52) U.S. Cl. ..... 2/2.5

(58) Field of Classification Search ..... 2/2.5, 2/94, 102, 69, 463–465, 108; 428/35.9, 36.1, 428/36.91, 911; 89/36.01, 36.02
See application file for complete search history.

(56) References Cited

U.S. PATENT DOCUMENTS 4,483,020 A * 11/1984 Dunn ..... 2/2.5
5,331,683 A * 7/1994 Stone et al. ..... 2/2.5
5,465,424 A * 11/1995 Cudney et al. ..... 2/462
5,771,489 A * 6/1998 Snedeker ..... 2/2.5
5,915,528 A * 6/1999 Shmuelov ..... 2/2.5
5,996,115 A * 12/1999 Mazelsky ..... 2/2.5

* cited by examiner

*Primary Examiner*—Tejash Patel
(74) *Attorney, Agent, or Firm*—Wood, Herron & Evans LLP

(57) ABSTRACT

An equestrian vest for a horseman has a plurality of selectively useable shock absorbing and impact resistant panels. Each panel comprises a grid or network of discrete pockets, each containing a shock absorbing or impact resistant element, respectively. Grid lines of the panels are aligned and oriented in overlapping fashion when the panels are assembled in a vest and the vest us this very flexible and form fitting, while offering significant user protection.

11 Claims, 4 Drawing Sheets

EQUESTRIAN VEST

This invention relates to protective garments for horsemen and more particularly to vests offering body protection from falls, hooves, obstacles and other potential trauma causes to which horsemen can be subjected.

In the past, it has been common to provide padded vests for horsemen to protect them from serious trauma from falls as they ride, or more particularly, compete, such as in hunting, jumping, steeple chasing or other horse riding activities. Such vests have generally comprised an outer carrier and internal padding. In one prior configuration, multiple layers of a foam padding are mounted in a vest carrier worn by a horseman. Another prior known vest includes a carrier where one of several foam layers is molded in a gridded pattern comprising a plurality of foam blocks integral within a grid work pattern of the same molded foam.

In the provision of vests for horsemen, numerous criteria are important, and certain compromises have been made, many of which detract from the overall protection needed, upon a fall, for example. For example, it is one desired function of a vest to spread or disperse the effects of an impact by an obstacle such as a branch, post, hoof or small ended obstacle. It is also a desired function to dissipate an impact over a larger area of the vest, and the body of a wearer to reduce human trauma from an impact. It is also a desired function to cushion any shock resulting from a blow to the horseman. Another desirable feature of such a vest is flexibility to accommodate the varied body shapes of horsemen of both genders, male and female. Other desirable features include: lightness in weight, sufficiently expansive coverage, ease of cleaning and adjustability in flex and protection levels, depending on rider and event characteristics, respectively.

In addition, it has been desirable in the past for the vest to be in compliance with ASTM F 1937-98 Standards. Rigid compliance with this standard makes it difficult to achieve flexibility and comfort desired in such a vest.

It will be recognized, for example, that prior vests cannot provide all these features in a single product; many are contradictory to each other.

For example, when sufficient padding or layers of padding are used for sufficient impact resistance and dissipation, vest weight increases and the vests gain rigidity. The heavier weight is detrimental and the lack of sufficient flex makes the vest stiff and less comfortable to the rider. Such vests are particularly difficult to conform to the female body form, for example.

Yet reduction in padding to lessen weight and to increase flexibility may result in insufficient impact resistance or dissipation, and in non-compliance with required standards or expectations of performance.

Moreover, current standards relate to the size of the neck opening. When the opening is increased in prior units for flexibility, the standards may not be met, or the vest rendered too loose for adequate protection.

Also, where prior vests utilize a carrier of material which absorbs water, moisture from the elements or from perspiration intrudes into the foam components, degrading them.

Accordingly, it has been one objective of the invention to provide an improved equestrian vest, complying with ASTM standards, which remaining sufficiently flexible and pliant for conforming to the body of a rider, male or female.

Another objective of the invention has been to provide an equestrian vest with an improved internal protection system offering desired impact resistance and dissipation in compliance with ASTM standards while, at the same time, providing flexibility beyond prior flexibilities of standard compliant vests.

Another objective of the invention is to provide an improved equestrian vest and vest padding system.

Another objective of the invention has been to provide an improved multiple layer, but flexible vest padding system.

Another objective of the invention has been to provide improved padding for equestrian vests.

A further objective of the invention has been to eliminate degradation of the shock absorbent elements of the vest from moisture.

A yet further objective of the invention has been to provide an improved equestrian vest in compliance with ASTM F 1937-98 Standard.

A still further objective of the invention has been to provide an equestrian vest with removable protective layers or elements for selective use against varied risks, while remaining conformable to ASTM F 1937-98 Standards with all critical layers included.

To these ends, an equestrian vest according to the invention comprises a vest front and a vest back, each comprised of multiple protective panels, each panel comprising a grid work of separate protective elements disposed in a matrix and held there by a welded matrix cover having a plurality of separate recesses orienting and independently positioning each element in dedicated grid pockets separately from other pockets. The pocket borders are sealed around each element in the panel and the borders are very flexible so each element is flexible along that border, with respect to the adjacent element. This provides substantial flexibility to the vest panel as a whole, while at the same time providing significant protection.

Preferably, and for maximum protection in both back and front, two outer panels, wherein each element in each pocket is a shock absorptive foam member, sandwich between them, an intermediate panel wherein the internal protective element is a relatively harder, rigid, impact resistant or dissipating member. Each of the two outer and the intermediate panels comprise grids with sealed pocket seams oriented in overlapping or indexed disposition when the panels are juxtaposed in a vest of the invention.

If the wearer moves or bends, the vest moves with him, all three panels being thus easily bendable at the common or overlapped fold lines between the protective elements. The effect is one of a highly flexible vest, offering very little resistance to bending, wearing and the like, fitting a variety of bodily moves. At the same time, the foam elements absorb and dissipate shock, while the intermediate panel of more rigid material provides substantial impact resistance and impact dispersion.

Preferably, the three panels comprising a vest front are predisposed in a different outline or configuration than elements in the panel back, primarily for fit, and for standard coverage compliance.

Each of the three panels in the front and in the back thus constitute a self-contained, articulated grid work of either shock absorbent or impact resistant elements, with the matrix comprising preferably a waterproof material such as, for example, PVC coated nylon, weldable or sealable by processes such as adhesive system, ultrasonic welding or Radio Frequency (RF) welding. Thus, each panel is also waterproof, with reference to prevention of moisture intrusion into the panel or the elements therein.

Each set of three panels is insertable into a vest or carrier sized to hold the panels in proper place on a user. The carrier can be a one piece unit, or a multiple piece unit, such as with separate front and back envelopes for carrying a respective three panel set. The carrier is provided with typical straps, tabs and fasteners or any suitable type to fit a wearer.

The carrier material can be moisture absorbent, for comfort, but no moisture can intrude into the panels themselves.

Thus, each front and back vest part is lightweight, highly flexible, highly shock absorptive and highly penetrant resistant, all at the same time providing a comfortable, highly protective vest for equestrians.

Moreover, if standard compliance is not a concern, and if a user is only worried about shock cushioning or resistance, for example, he can customize the vest to use only one or two of the shock absorbent panels, and not the impact resistant panel in each carrier. If only worried about impact risk, he can only use that panel and eliminate the two shock absorbent panels. The vest is thus highly customized to provide a required resistance to a specific risk with attendant flexibility and weight advantages. At the same time, the vest can be set up to meet applicable standards by using all three internal panels in front and back while still providing a high degree of flexibility and apparent light weight.

These and other objective and advantages will become readily apparent from the following written description of the invention and from the drawings in which.

Figure 1:
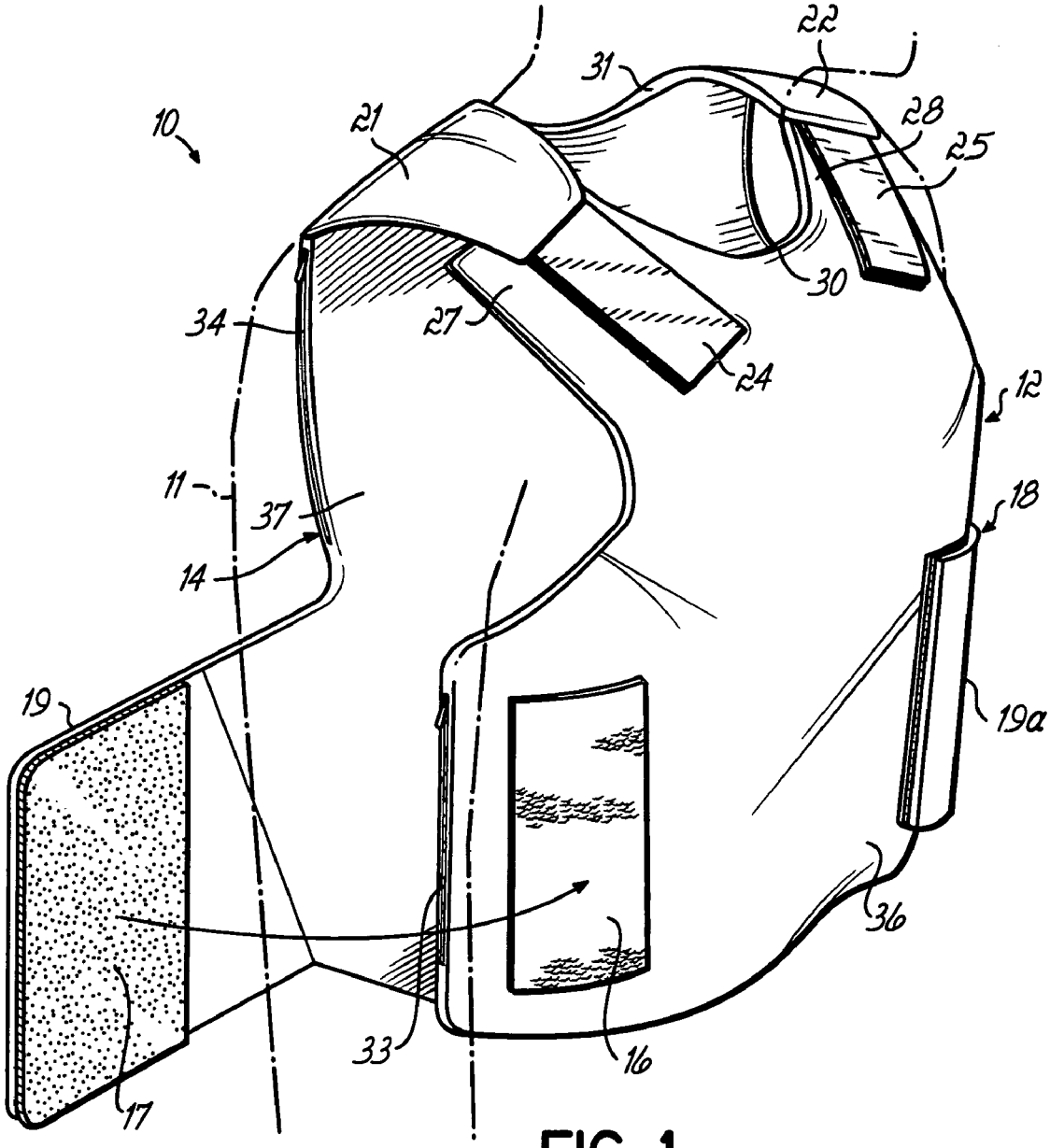
FIG. 1 is a perspective illustration showing an equestrian vest according to the invention.

Turning now to the drawings, there is shown in FIG. 1 an equestrian vest 10 according to the preferred embodiment of the invention, and diagrammatically illustrated on place on a user 11. As shown in FIG. 1, the vest has a front portion 12 and a rear portion 14.

Generally the front portion of the vest is provided with one component 16 of a hook and loop fastener, the other component 17 of which is located on a flap 19, 19*a* of the back portion 14 of the vest. Components 16, 17 make up a hook and loop fastener, such as that shown at 18 on the other side of the vest where the flap 19*a* has been placed over the front of the vest so that the hook and loop fastener component, 16, 17 are joined together to form a interconnection of the flap 19*a* with the front portion 12 of the vest.

The flap 19 with the cooperating components 16, 17 on the righthand side of the vest are shown in an open manner to simply illustrate the opening and closing of the side of the vest about the body of a user 11. The same structure is disclosed on the other side with respect to flap 19*a*, for example.

Over the shoulder tabs 21, 22 are extended from the rear portion 14 of the vest upwardly and over the shoulders of a user 11. Tabs 24, 25 extend from the respective tabs 21, 22 and each of which has a single component of a two component fastener, such as "velcro" for fastening over another operable component thereof located on upstanding tabs 27, 28 of the front 12 of the vest 10.

The upper portion of the front 12 of the vest is scooped out, as at 30, to accommodate the neck of a user 11 while the rear 14 of the vest is scooped out, as at 31, to provide for the back of a user's neck.

As further shown in FIG. 1, a zipper 33 is applied at an edge of the front portion 12 of the vest to accommodate the panels of the invention as will be described. In like manner, a zipper 34 is applied along an edge of the rear portion 14 of the vest to accommodate panels in the vest back.

As will be described, each of the front portion 12 and rear portion 14 of the vest is preferably provided with a series of panels as will now be described, for the purpose of providing impact resistance and shock cushioning to the wearer of the vest.

It will be appreciated that the front 12 of the vest comprises a carrier envelope 36 which may be made of any suitable material and which defines a carrier for the panels of the vest as will be described. In like manner, the rear 14 of the vest is defined by a carrier envelope 37 for carrying the panels as will be described in the back of the vest. These carriers can be made of any suitable materials. Preferably, the inner layers which would be next to a user are made for "wicking" type material. Any such suitable material could be used. One such material is known as "TRANSPOR" material, made by Southern Mills of Union City, Ga., or "TRANSPAR" treated fabric supplied by Dry Fiber, Inc. of Minneapolis, Minn.

Zippers 33 and 34, respectively, provide access to the interior of the envelopes or carriers 36, 37 for the insertion of the panels.

Finally, with respect to FIG. 1, it will be appreciated that the flaps 19 and 19*a* of the vest are extended from the rear 14 and around toward the front, under the arms, of the user.

Figure 2:
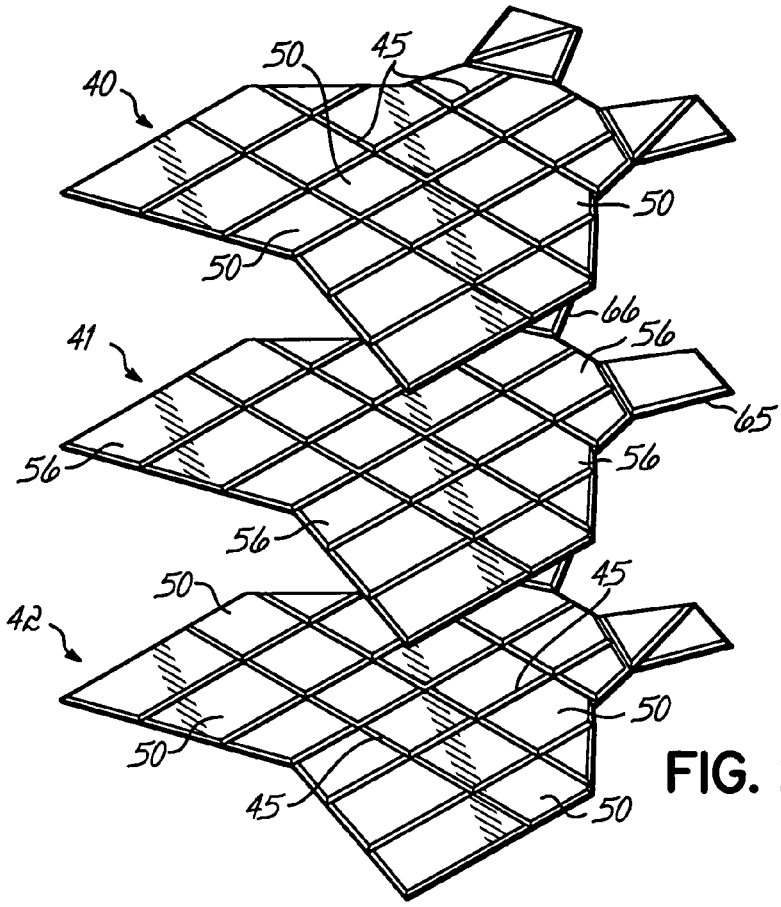
FIG. 2 is an exploded perspective view showing a set of three panels according to the invention.
Figure 3:
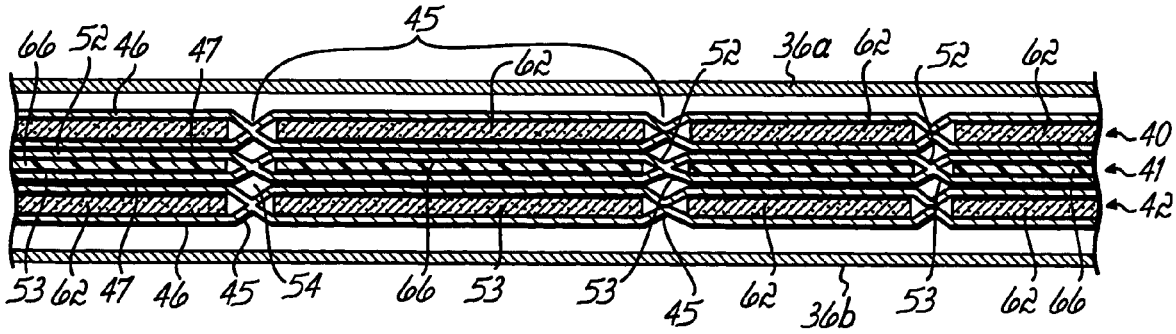
FIG. 3 is a cross-sectional view illustrating configuration of three front panels in a front carrier of the vest of FIG. 1.
Figure 4:
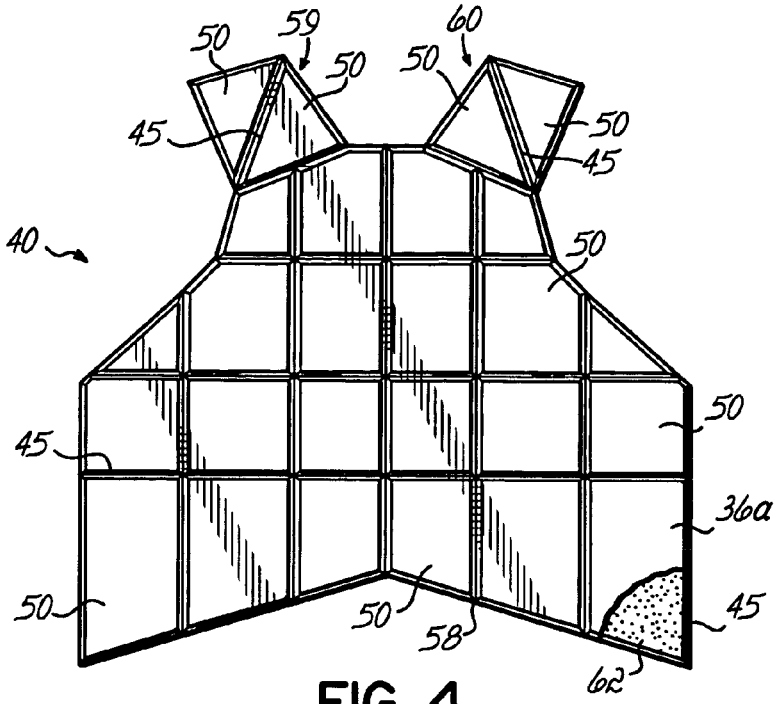
FIG. 4 is an elevational view of the impact resistant panels of FIGS. 2 and 3.

Turning now to FIGS. 2–4, a plurality of panels 40, 41, 42 for the front 12 of the vest are illustrated. In FIG. 2, it will be appreciated that each of the panels is substantially identical in scope and extent, but not in content, as will be described.

Preferably, panels 40 and 42 are identical, while panel 41 differs, the difference being in the internal components of each panel. It will be appreciated that each panel is made from an outer covering of any suitable material and preferably moisture-impervious material including liquid and vapor-proof parameters. Such material may be, for example, PVC impregnated 70 denier nylon, or polyethylene or any other suitable material, preferably moisture impervious. One such suitable cover material is supplied by Intex Plastics Corporation of Corinth, Miss. under its mark "SPORTS-MATES".

It will further be appreciated that each of the panels 40 through 42 are defined by a grid-like structure. Panels 40 and 42 are preferably identical, as noted, and each of these panels is defined in part by flexible grid-like lines or seams between the panel cover members, such as at 45, defined by direct joining of outside and inside cover members 46 and 47 in each of the panels to define distinct pockets therein. These cover members are preferably, as noted above, PVC impregnated nylon, but may be of any suitable material. The grid or seam lines where the outside and inside cover members 46, 47 are joined together are formed by any suitable joining technique, such as radio-frequency welding, or by dielectric seal, or by other adhesion or joining techniques, so that a plurality of distinct pockets 50 are formed or defined in each of the panels 40 and 42, only some of which are numbered in FIG. 2.

Likewise, panel 41 is defined by inner and outer covers 52, 53. The panels 41 include grid lines 54, where the inner and outer cover members 52, 53 are joined together by any suitable technique, such as radio-frequency welding or any other adhesive or bonding technique, to form distinct pockets in the panel. The inner and outer cover members are preferably made from a moisture-proof material preventing the transmission of vapor and liquid, and the grid or seam lines are formed at the joints where the inner and outer covers are joined together by the sealing techniques noted above. The grid lines 54 form distinct pockets 56 in the panel 41.

FIG. 3 discloses a plurality of panels 40, 41 and 42 located within the envelope or front carrier 36 of a vest 10. As will be appreciated, the carrier 36 comprises an outer carrier layer 36*a* and an inner carrier layer 36*b*. The carrier may be made from any suitable material. It has been found preferable to use a wicking type material, at least for the layer 36*b* or the inner layer, which would reside next to the user or wearer of the vest for moisture transmission outwardly from between the vest and the user 11. Nevertheless, and despite the composition of the materials in the carrier layers 36*a* and 36*b*, no moisture can seep into the interior of the panels 40, 41 or 42 in view of the fact that the covers of these panels are moisture impervious.

Turning now to FIG. 4, a front or elevational view of one of the panels 40 is illustrated therein. It will be appreciated that each of the panels 40, 42, which are preferably identical, have the shape shown in FIG. 4, with a V-shaped bottom edge such as at 58 and at the top, two tabs 59, 60, which will reside in the tabs 27, 28 of the front carrier 36 and over the collarbone area of the user 11 when in use. The tabs 59 and 60 each comprise two pockets 50 and each of the pockets 50, throughout these tabs and the remainder of the panel 40 include and encompass an impact-resistant and dispersion material, such as at 62, as shown in the lower right hand corner of FIG. 4 with a portion of the cover 36*a* broken away for illustration.

The shock dispersion or absorbent material may comprise a foam 62 or may be of any suitable material for absorbing and dissipating shock and impact. One suitable shock absorbing material is that ⅜ inch thick pink foam supplied by EAR Specialty Composites of Indianapolis, Ind., under its designation "Pink CF-42" or its "CONFOR" line of ergonomic foams. Any such suitable material can be utilized.

Referring momentarily back to FIG. 2, it will be appreciated that panel 41 is made similarly to panels 40, 42 with the following exceptions. First, panel 41 has two upstanding tabs 65, 66 defined by a single pocket between the inner and outer covers 52, 53. The pockets defined in the tabs 65, 66, include internally of the cover members 52, 53 a plate of high impact polystyrene material or other suitable composition, for resisting and dispersing impact. One suitable material is known as high impact polystyrene about ⅛ inch in thickness. Over the clavicle areas, which tabs 65, 66 will cover, the solid plates in these tabs provide significant impact-resistance in these particular areas. The remainder of the pockets 56 in plate 41 also include panels of high impact polystyrene 66, preferably, for resisting impact.

It will be appreciated that the flexible grid or seam lines 54 in the panel 41 are of the same orientation as the grid lines 45 in the panels 40, 42.

Accordingly, and as shown in FIGS. 2 and 3, when the panels 40, 41 and 42 are juxtaposed with respect to each other, and internally of the cover 36, the grid or seam lines in essence are aligned, indexed or matched up so that the entire vest front 12, for example, is flexible about each of these grid lines. Further in this regard, it will be noted that neither the foam material 62 nor the high impact material 66 in any of the panel, overlap the grid lines, thereby promoting significant flexibility of the vest about any of the aligned seam lines, even when all three panels are juxtaposed together.

Figure 5:
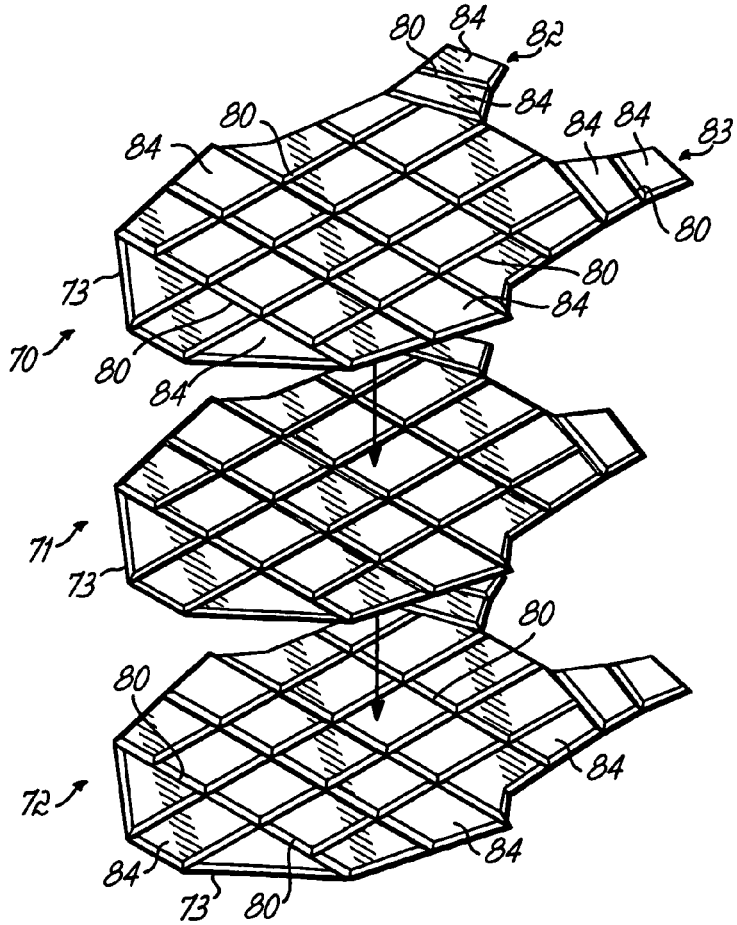
FIG. 5 is a view similar to FIG. 2 but showing a set of panels for a rear carrier of the vest of FIG. 1.
Figure 6:
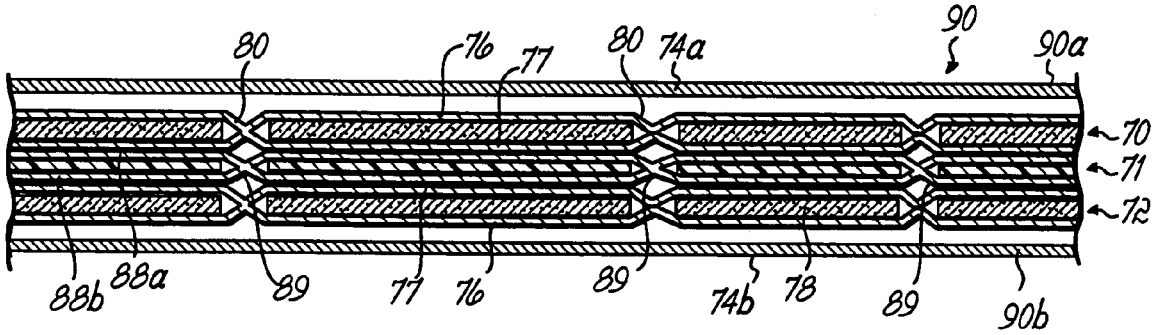
FIG. 6 is a cross-sectional view of three panels of FIG. 5 in a carrier of the rear vest portion of FIG. 1.
Figure 7:
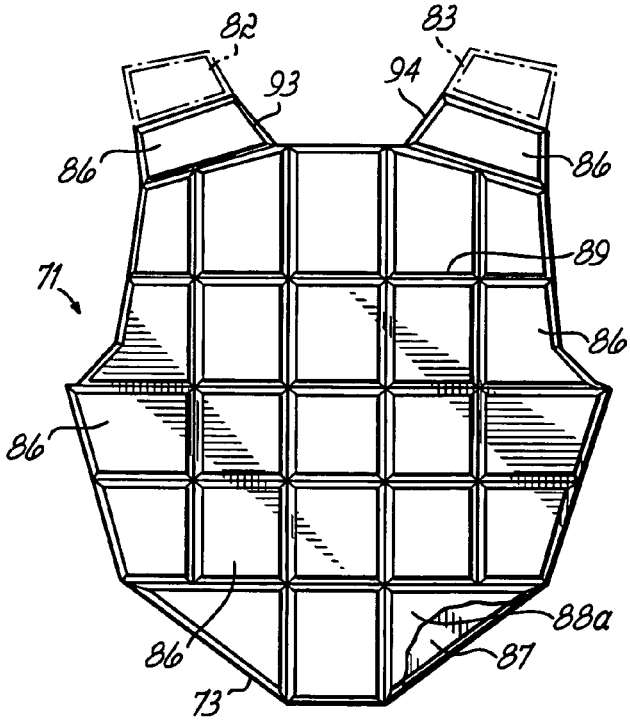
FIG. 7 is an elevational view of a panel or a back portion of the vest of FIG. 1.

Turning now to FIGS. 5–7, there is illustrated therein various components of the rear portion 14 of the vest 10 which is of somewhat similar construction as is the cover and the interior panels of the front portion. The differences reside primarily in the shape of the individual rear panels 70, 71 and 72 and the variation of the upper tabs of the impact resistant panel 71 as will be described.

FIG. 5 shows an expanded view of the three panels 70 through 72 while FIG. 6 shows a cross-section of those panels located within a carrier 74, having an outer carrier side 74*a* and an inner carrier side 74*b*. Carrier 74 is similar to the same material as carrier 36 of the vest front portion 12. Each panel 70 and 72 are identical in construction. Each includes an inner and outer cover member 76, 77 of moisture impervious material similar to the cover members 46, 47 of panels 40 and 42. Each of the panels also includes a plurality of pockets including within them an impact absorbing foam material 78 of any suitable construction. Such foam may be exactly as described above with respect to panels 40 and 42.

In addition, the cover members 76, 77 are joined together to form the flexible grid or seam lines 80 or as shown in FIG. 5. The joining of the grid or seam lines 80 comprise the welding or adhesion of the cover members 76, 77 together, outside the foam material 78. Any such joining technique which is suitable can be used, such as by radio-frequency welding or any other adhesive or bonding technique, as with panels 40, 42. Each of the panels 70, 72 have upwardly extending tabs 82, 83 comprising two pockets 84 defined by the grid or seam lines 80 and the tabs 82, 83.

Likewise, throughout the rest of the panels 70, 72, distinct pockets 84 are defined by the various grid or seam lines 80 and each contain a segment of a shock absorbing material such as the foam material described above. The foam in each pocket is shaped similarly to the pocket shape as shown in FIG. 5.

An elevational view of panel 71 is illustrated in FIG. 7. This panel is similar to those of 70, 72, with the exception of the various pockets, such as pockets 86, as shown in FIG. 7, contain a segment or a plate of high impact material such as high impact resistant polystyrene 87 shown in the lower righthand corner of FIG. 7 wherein part of the cover member 88*a* has been broken away for illustrative purposes.

The cover member on the other side of the plate 87 is shown at 88*b* in FIG. 6 and it is the joining 6*f* these two inner and outer cover members 88*a*, 88*b* at flexible grid or seam lines 89, which form the grid work pattern in panel 71 as shown in FIG. 7. These grid lines 89 are formed by joining the inner and outer cover members 88*a* and 88*b* by any suitable welding technique, such as radio-frequency welding or any other adhesive or bonding technique. The cover members 88*a*, 88*b* are similar to the cover members 76, 77 in the panel 70, 72 and are moisture impervious including liquid and vapor imperviousness. Preferably, these cover materials can be a PVC coated nylon or any other suitable material.

The panels 70, 71, 72 are preferably sandwiched together as illustrated in the cross-section of FIG. 6, within a carrier 90, having inner and outer layers 90*a* and 90*b* as shown in FIG. 6. Carrier 90 can be formed of any suitable material and is preferably at least in the inner cover 90*b*, provided with a wicking material for transporting moisture between the user and the vest 10.

Turning again to FIG. 7, it will be appreciated that the panel 71 has two upstanding tabs 93 and 94 defined by only one pocket 86. As shown in FIG. 7, the upstanding tabs 82, 83 which are on panels, such as panels 71, 72, behind or under panel 71, extend above the tabs 93, 94 of the panel 71. Accordingly, the impact resistant panel 71 does not extend over the full breadth of the panels 70, 72 when the panels are juxtaposed together, but rather the tabs 93, 94 are one pocket short of the outward most extension of the tabs 82, 83 of panels 70 and 72. Nevertheless, as in all the panels described herein, the respective seam lines in all panels overlap for flexibility when the panels are juxtaposed in a carrier.

Also, it is noted the bottom edge 73 of panels 70–72 is shaped as shown to facilitate protective coverage on the back of a user.

Nevertheless, when it is desired to meet the current specifications, and be in compliance with current standards, it is possible to lay a sandwich of panels 70, 71 and 72 within the zipper 34 of the rear 14 of the vest. The panels are spread out with the grid or seam lines 80 and 89 juxtaposed, aligned or indexed with respect to each other, so that the entire rear 14 of the vest can be flexed about any of the grid lines and any of the directions of the grid lines similar to the flex or characteristics of the front part 12 of the vest described above.

Accordingly, both the front 12 and the rear 14 of the vest 10 remain highly flexible, while still retaining great impact resistance and shock dispersion. Both the front and the rear of the vest can be flexed about any of the respective grid or seam lines described above, so as to conform to body shapes of varying gender and size, for example. This construction of panels sandwiched together to provide both impact resistance and shock dispersion and at the same time, produces great flexibility, produce a vest which is standard compliant and yet highly flexible and of relatively light weight.

Preferably, the pocket sizes of the panels are selected so that when any horseshoe is contacting the vest, it overlays at least three of the pockets.

It should also be noted that the terms "shock absorbing material" and "impact resistant material" are used herein as described herein. Further the terms are relatively used where shock absorbing material is a material softer and more resilient (such as, for example only, a foam) than the harder impact resistant, less resilient material (such as, for for example only, high impact polystyrene).

When it is desired to wear a vest as described, the user simply joins the front 12 with the rear 14, such as through the use of the various tabs and fasteners as suggested and described with respect to FIG. 1. The neck scoop areas 30, 31 are sized to meet with any applicable standard, as are the armholes, provided by the joining of both vest parts.

Moreover, if it is not necessary to comply with a standard which requires all of the foam and impact resistant panels, such as 40, 41, 42 or 70, 71, 72, one or two of the panels can be eliminated. For example, if only more general shock dispersion is required, only two panels 40, 42 or 70, 72 can be used, or only one of those panels is used in respect to the front and rear of the vest. On the other hand, if more impact resistance risk is to be accommodated, then the foam panels 40, 42 and 70, 72 can be all together omitted where the general shock absorption they provide is not deemed necessary or vest thickness is desireably reduced and only the impact resistant panels 41 and 71 can be used within the respective carriers 36, 37.

Accordingly, the vest can be customized by inserting or removing panels through respective zippers 33, 34 in the fronts 12, 14 of the vest, to meet different and anticipated risks and/or to fully comply with any applicable standard or requirement in any particular usage or competition. The utilization of the multiple panels within the carriers 36, 37 thus provide a highly flexible vest which meets substantial impact resistant and shock absorbing standards.

These and other benefits and modifications will be readily apparent to one of ordinary skill in the art without departing from the scope of this invention and applicant intends to be bound only by the claims appended hereto.

The invention claimed is:

1. A protective vest comprising:

a panel carrier;

two foam shock absorbing panels;

a impact resistant panel, each of said panels comprising a cover defining a plurality of separate and distinct pockets, each containing a panel element;

respective pockets of respective panels aligned with each other when said panels are disposed in said panel carrier.

2. A vest as in claim 1 wherein a shock absorbing material is disposed in said pockets of said shock absorbing panels.

3. A vest as in claim 2 wherein a rigid impact resistant material is disposed in said pockets of said impact resistant panel.

4. A vest as in claim 3 wherein said impact resistant panel is disposed between said shock absorbing panels in said carrier.

5. A vest as in claim 4 wherein said cover comprises a front cover member and a back cover member, said members joined together in a flexible seam between pockets in a panel.

6. A vest as in claim 5 wherein said seams of said respective panels are aligned with seams of other panels in said carrier.

7. A vest as in claim 1 wherein said cover is moisture impervious.

8. A protective vest comprising:

a panel carrier;

a plurality of independent panels in said carrier;

each panel having a cover defining a plurality of seams surrounding respective pockets in each said panel;

said pockets of one of said panels in said carrier containing a shock absorbing material therein and said pockets of another of said panels in said carrier containing an impact resistant material therein;

said seams of one of said one and said another panels in each carrier being aligned with seams of the other of said panels in said carrier, said panels being flexible along said aligned seams.

9. A flexible protective vest comprising:

a panel carrier;

at least two panels in said carrier;

said panels each comprising a plurality of discrete pockets defined by surrounding seam lines and said pockets of at least one panel in said carrier each containing a shock absorbing material consisting of a unitary layer thereof;

said seam lines of all said pockets in said two panels being aligned and said panels being flexible together about said aligned seam lines.

10. A flexible protective vest comprising:

a panel carrier;

at least two panels in said carrier;

said panels each comprising a plurality of discrete pockets defined by surrounding seam lines and said pockets of one of said panels in said carrier each containing an of impact resistant material consisting of a unitary layer thereof;

said seam lines of all said pockets in said two panels being aligned and said panels being flexible together about said aligned seam lines.

11. A convertible, flexible, protective vest comprising:

a carrier;

at least three panels for selective use in said carrier;

each of said panels comprising a plurality of distinct pockets defined by flexible seam lines between pockets;

at least one of said panels in said carrier having shock absorbing material in its said pockets;

at least a second of said panels in said carrier having impact dispersing material in its said pockets;

said seam lines of all panels in said carrier selectively juxtaposed in said carrier, being aligned such that said carrier and said panels therein are flexible along said seam lines.

* * * * *